US012127583B2

(12) United States Patent
Hagen

(10) Patent No.: US 12,127,583 B2
(45) Date of Patent: Oct. 29, 2024

(54) VARIABLE-USE CAPSULE FOR A HOOKAH

(71) Applicant: AIR IP HOLDINGS LIMITED, Dubai (AE)

(72) Inventor: Klaus Hagen, Haren (DE)

(73) Assignee: AIR IP HOLDINGS LIMITED, Dubai (AE)

( * ) Notice: Subject to any disclaimer, the term of this patent is extended or adjusted under 35 U.S.C. 154(b) by 718 days.

(21) Appl. No.: 17/271,944

(22) PCT Filed: Aug. 29, 2018

(86) PCT No.: PCT/DE2018/100741

§ 371 (c)(1),
(2) Date: Feb. 26, 2021

(87) PCT Pub. No.: WO2020/043225

PCT Pub. Date: Mar. 5, 2020

(65) Prior Publication Data

US 2021/0321663 A1 Oct. 21, 2021

(51) Int. Cl.
*A24D 1/14* (2006.01)
*A24F 1/30* (2006.01)
(Continued)

(52) U.S. Cl.
CPC ..... *A24D 1/14* (2013.01); *A24F 1/30* (2013.01); *A24F 40/20* (2020.01); *A24F 40/42* (2020.01);
(Continued)

(58) Field of Classification Search
CPC .. A24F 1/30; A24F 40/20; A24F 40/42; A24F 40/485; A24D 1/14; B65D 25/108; B65D 51/245
See application file for complete search history.

(56) References Cited

U.S. PATENT DOCUMENTS 7,775,218 B2 8/2010 Shraiber
9,968,128 B2 * 5/2018 Alfawaz ..... A24F 1/30
(Continued)

FOREIGN PATENT DOCUMENTS

CN 201336930 Y 11/2009
CN 104522890 A 4/2015
(Continued)

*Primary Examiner* — Abdullah A Riyami
*Assistant Examiner* — Thang H Nguyen
(74) *Attorney, Agent, or Firm* — Hayes Soloway P.C.

(57) ABSTRACT

A capsule (1) made of a heat-resistant material serves for storing a smoking medium provided for extraction, in particular for storing tobacco with or without other heatable additives for an electronic hookah (30), with an air inlet (2) and an air/smoking medium outlet (3), and with a side wall (4) fixing both of these at a distance from each other, wherein both the air inlet (2) and the air/smoking medium outlet (3) have a plurality of through-holes (6, 8, 10) and/or through-slits (7, 9, 1). The air inlet (2) and/or the air/smoking medium outlet (3) with the through-holes (6, 8, 10) are plate-shaped and are designed to be connected releasably to the side wall (4) by the user and to be reusable, wherein the side wall (4) is at the same time also designed to maintain the distance between air inlet plate (5) and air/smoking medium outlet plate (12).

19 Claims, 5 Drawing Sheets

(51) Int. Cl.

| | |
|---|---|
| ***A24F 40/20*** | (2020.01) |
| ***A24F 40/42*** | (2020.01) |
| ***A24F 40/485*** | (2020.01) |
| ***B65D 25/10*** | (2006.01) |
| ***B65D 51/24*** | (2006.01) |

(52) U.S. Cl.
CPC ..... *A24F 40/485* (2020.01); *B65D 25/108* (2013.01); *B65D 51/245* (2013.01)

(56) References Cited

U.S. PATENT DOCUMENTS

| | | | | |
|---|---|---|---|---|
| 10,165,796 | B2 * | 1/2019 | Gebara | A24F 5/00 |
| 2006/0207621 | A1 * | 9/2006 | Shraiber | A24F 1/30 131/173 |
| 2008/0060663 | A1 * | 3/2008 | Hamade | A24B 13/00 131/178 |
| 2010/0186091 | A1 | 7/2010 | Turner et al. | |
| 2011/0186060 | A1 | 8/2011 | Saleh | |
| 2014/0069446 | A1 | 3/2014 | Haddad et al. | |
| 2014/0230832 | A1 | 8/2014 | Saliman | |
| 2016/0157520 | A1 * | 6/2016 | Alfawaz | A24F 1/30 131/226 |
| 2016/0235122 | A1 | 8/2016 | Krietzman | |
| 2016/0331913 | A1 | 11/2016 | Bourque | |
| 2017/0099873 | A1 | 4/2017 | Benjamignan et al. | |
| 2017/0172203 | A1 * | 6/2017 | Gebara | A24D 1/14 |
| 2021/0259307 | A1 * | 8/2021 | Pijnenburg | A24F 40/485 |

FOREIGN PATENT DOCUMENTS

| | | | | |
|---|---|---|---|---|
| CN | 2015097424 | A | 4/2015 | |
| DE | 202008010123 | U1 | 4/2009 | |
| DE | 202016106830 | U1 | 12/2016 | |
| DE | 102015121435 | A1 | 5/2017 | |
| WO | 2014118787 | A1 | 8/2014 | |
| WO | WO-2019215347 | A1 * | 11/2019 | A24D 1/14 |
| WO | WO-2020012330 | A1 * | 1/2020 | A24B 15/167 |

* cited by examiner

VARIABLE-USE CAPSULE FOR A HOOKAH

CROSS-REFERENCE TO RELATED APPLICATIONS AND PRIORITY

This patent application claims priority from PCT Patent Application No. PCT/DE2018/100741 filed Aug. 29, 2018. This patent application is herein incorporated by reference in its entirety.

BACKGROUND OF THE INVENTION

The invention relates to a capsule made of a heat-resistant material for storing a smoking medium intended for extraction, in particular capsule for storing tobacco without or with other heatable ingredients for an electronic waterpipe, having an air inlet and an air-smoking medium outlet and a side wall fixing them spaced apart from one another, wherein both the air inlet and the air-smoking medium outlet have a plurality of through-holes and/or slots.

In addition, the invention relates to a capsule made of a heat-resistant material for storing a smoking medium intended for extraction, in particular a capsule for storing tobacco without or with other heatable additives for an electronic waterpipe, having an air inlet and an air-smoking medium outlet and a side wall fixing them spaced apart from each other, wherein both the air inlet and the air-smoking medium outlet have a plurality of through-holes and/or slots.

TECHNICAL FIELD

Oriental waterpipes, also known as shisha, and electrically operated vapourisers are becoming increasingly popular. Traditional waterpipes do not use a defined smoking medium, such as tobacco, and the ingredients are not clearly labelled. The qualitative and legally compliant filling of shishas is not guaranteed, as filling is done manually. Because traditional shishas are heated with glowing charcoal, they should only be used outdoors or in rooms with a guaranteed supply of fresh air, as otherwise there is a real risk of carbon monoxide poisoning. Electronic cigarettes or hookahs use a liquid that is vapourised by an integrated electric or electronic heater. Thus, in these aspects, it is almost impossible to simulate the traditional smoking experience and sensation with previously known devices. A waterpipe is known from DE 10 2015 121 435.0 with a capsule, which is inserted from below into the heating chamber, from which the heated smoking medium then passes towards the suction tube and from there into the water container. Such capsules may contain tobacco or non-tobacco smoking medium in the most varied forms, e.g. as solid, dry, fermented or moist medium with or without tea or nicotine, in different intensities and flavours or with additives. The capsule is simply inserted into the heating chamber and can then be removed again just as easily after use without leaving any residue and disposed of properly. The heating element in the chamber and the capsule have a matching shape so that the capsule can be easily inserted into the heating element and locked in place. Both the air inlet side and the smoking medium outlet side are formed with holes or slots that allow the air to enter and the mixture to exit. The closures covering the inlet and the smoking medium outlet are made of heat-resistant material and are firmly connected to the side wall, so that the contents cannot be changed for the smoker. This can be expedient or even necessary for particular reasons, so that then the smoker has no choice but to throw away or otherwise dispose of a capsule that is of no interest due to the smoking medium composition. Another disadvantage is that such a capsule can be used only once, so that a relatively large number of such residual capsules also pollute the environment.

The invention is therefore based on the objective of developing a variable-use and easily handleable capsule for electronic waterpipes.

According to a first embodiment of the invention, the objective is achieved in that the air inlet and/or air-smoking medium outlet with the through-holes are in the form of plates and are releasably connected to the side wall by the consumer and are configured to be reusable, the side wall at the same time being formed to also maintain the spacing of air inlet plate and air outlet plate.

With such a capsule, a multiple-use container is created which, due to its shape and stability, can be reliably inserted multiple times into the heating coil of the heating chamber and then removed therefrom to be used again after cooling and emptying. This is made possible by the possibility of connecting the air inlet plate, which is sufficiently rigid and stable, to the side wall, which in turn is formed in such a way that its stability allows it to be used multiple times. The air and smoking medium outlet plate, on the other hand, can be connected to the side wall in such a way that they form a stable unit, because it does not necessarily have to be removable for the filling and emptying process. Thus, if the smoker finds, for example, that the composition of the smoking medium does not suit his taste, he can remove the contents and replace it with one he prefers. Moreover, after the capsule has been used once, he can then empty it and refill it for a second and/or third and fourth smoking session. Due to the configuration of the capsule, i.e. the side wall and the two plates, there is no fear of denting or damaging the capsule.

According to a second embodiment of the invention, the objective according to the invention is achieved in that the air inlet and/or air-smoking medium outlet with the through-holes are in the form of plates and are non-releasably connectable to the side wall by the consumer and are configured to be non-reusable, the side wall at the same time being formed to also maintain the spacing of air inlet plate and air outlet plate.

The point of this variant is that the capsule is closed after individual filling and is thus formed to a certain extent as a disposable capsule. The air inlet and/or the air-smoking medium outlet are fixed firmly to the side wall after filling by the user/operator, so that it would only be possible to open the capsule by applying a certain amount of force.

According to a practical embodiment, the air inlet plate has an external thread that is formed to correspond with the internal thread on the upper edge of the side wall. The necessary sealing tightness can be achieved through such a screw cap and also ensures that the consumer can remove the air inlet plate without much effort and then refill the capsule.

Another possible way of connecting the air inlet plate to the side wall is where the air inlet plate is interlocked with the upper edge of the side wall or is interlocked in addition to the thread. Thus, if the smoker had been a little careless when filling or reinserting the capsule, the second type of connection, i.e. interlocking, would still ensure that the capsule could be successfully inserted. Moreover, interlocking would be considered to be a non-releasable connection.

The same applies if the air intake plate has a click-connection to the upper edge of the side wall or has a click-connection in addition to the thread. Of course, it is also possible to have only a click-connection or interlocking, depending on which type of connection proves advantageous in use.

Another possible way of connecting the air inlet plate and the side wall is that the air inlet plate is releasably connected to the upper edge of the side wall by means of a hook-and-loop fastener, so that, in order to achieve the necessary connection, it is only necessary to press the air inlet plate onto this wall.

It is advantageous with such a hook-and-loop fastener for the catch part of the hook-and-loop fastener to be associated with the upper edge of the side wall, which is easily possible because the upper edge is formed with a widened edge surface. This provides a sufficiently effective surface for the connection, which ensures that, after it has been positioned and pressed on, the air inlet plate securely holds the smoking medium in the capsule.

The through-holes or through-slots must be dimensioned in such a way that the smoking medium in the capsule does not seep out again or even flow. Especially with corresponding additives, this is not entirely easy. To prevent this, the invention provides that the air inlet plate has through-holes which are closed in a predetermined arrangement in the passive state and which, when a suction force is applied by the smoker, are formed so as to be passable for the smoking medium due to the pressure. It is conceivable to use small valves that also offer the possibility of inserting such a capsule multiple times. Given the large number of insertion holes that are used, such valves must of course not be too complex.

One possibility for such "valves" is that the through-holes are closed in a passive state by means of a foil that bursts at a given pressure. After bursting once, the foil will not re-close the through-holes 100%, but such a limited sealing foil is nonetheless sufficient.

A complementary solution provides that the air inlet plate and the air-smoking medium outlet plate are equipped with through-holes or through-slots, which, when the smoker sucks in, are formed so as to open due to the resulting pressure. Normally it is sufficient for the through-holes to be formed in a closeable manner in the air inlet plate, which is arranged at the base of the housing of the waterpipe, but it may also be expedient for such arrangements to be associated with the air-smoking medium outlet plate.

In order to allow the pressure to act very specifically on, for example, the foil, it is expedient for the through-holes to be funnel-shaped, preferably in the air inlet plate, towards the smoking medium. This funnel-shape also leads to an increase in the air speed, which is advantageous for the smoke formation process.

In order to be able to easily handle the air inlet plate, which is what is to be releasably connected to the side wall, the invention provides that the air inlet plate is equipped with an externally seated grip that is formed so as to be foldable. The fact that it is foldable means that it cannot interfere with the other components, whereby after it has been folded out it can have a positive influence on the opening and also the closing process of the air inlet plate, in particular for rotary closure, i.e. the threading.

Although according to the embodiment described above, the air inlet plate in particular is formed so as to be sealed during storage, it may be advantageous to place the capsules in special storage facilities or the like. According to the invention, the capsules are to be assigned to sales cartons which have storage recesses adapted to the capsule shape and have a lid with advertising space. This ensures that the capsules filled into the sales carton are stored securely without slippage, i.e. that they do not change their position, so that the smoking medium in the capsule cannot be affected.

In order to also give sales quantities in an appropriate form, the invention also provides for the sales cartons to have six or twelve storage recesses, thus giving appropriate sizes for sale. Of course, it is also possible to create sales carton sizes corresponding to the quantity of cigarettes, but this will not usually be necessary or appropriate.

It has been pointed out above that the smoker usually wants to smoke his particular smoking medium composition, which he can conveniently recognise when he buys such a sales box in that the air inlet plate, the lid and/or the storage recesses have the same or almost the same colouration, so that he knows immediately that all the capsules stored in the sales box have the same content or have a specific content and that he does not need a mixture, or from the outset he knows on the basis of knowledge of the respective capsules what mixtures he wants to make.

If re-use is not practical, but the handling of the capsule is necessary and the separate disposal of the capsule and its contents is desirable, the invention provides a practical solution in that the capsule is connected to the side wall and equipped with tongues which can be broken off for opening, whereby the side wall is at the same time formed so as to maintain the spacing between the air inlet plate and the air-smoking medium outlet plate.

The invention is characterised in particular by the fact that a capsule for electronic waterpipe smoking has been created which is very versatile and which enables the consumer, i.e. the smoker, to find just the composition of the smoking medium that he wants and that he wants to smoke. Moreover, he can easily remove the ashes of the smoking medium from such a capsule and fill it again himself and then use it another time or multiple times, which leads to a substantial reduction of the burden on the environment. It is also possible for the capsule to be firmly closed with the side wall when the air inlet and/or the air-smoking medium outlet are brought together.

BRIEF DESCRIPTION OF THE DRAWINGS

Further details and advantages of the subject-matter of the invention will be apparent from the following description of the accompanying drawing, in which a preferred exemplary embodiment is shown with the necessary details and components.

DETAILED DESCRIPTION OF THE DRAWINGS

Figure 1:
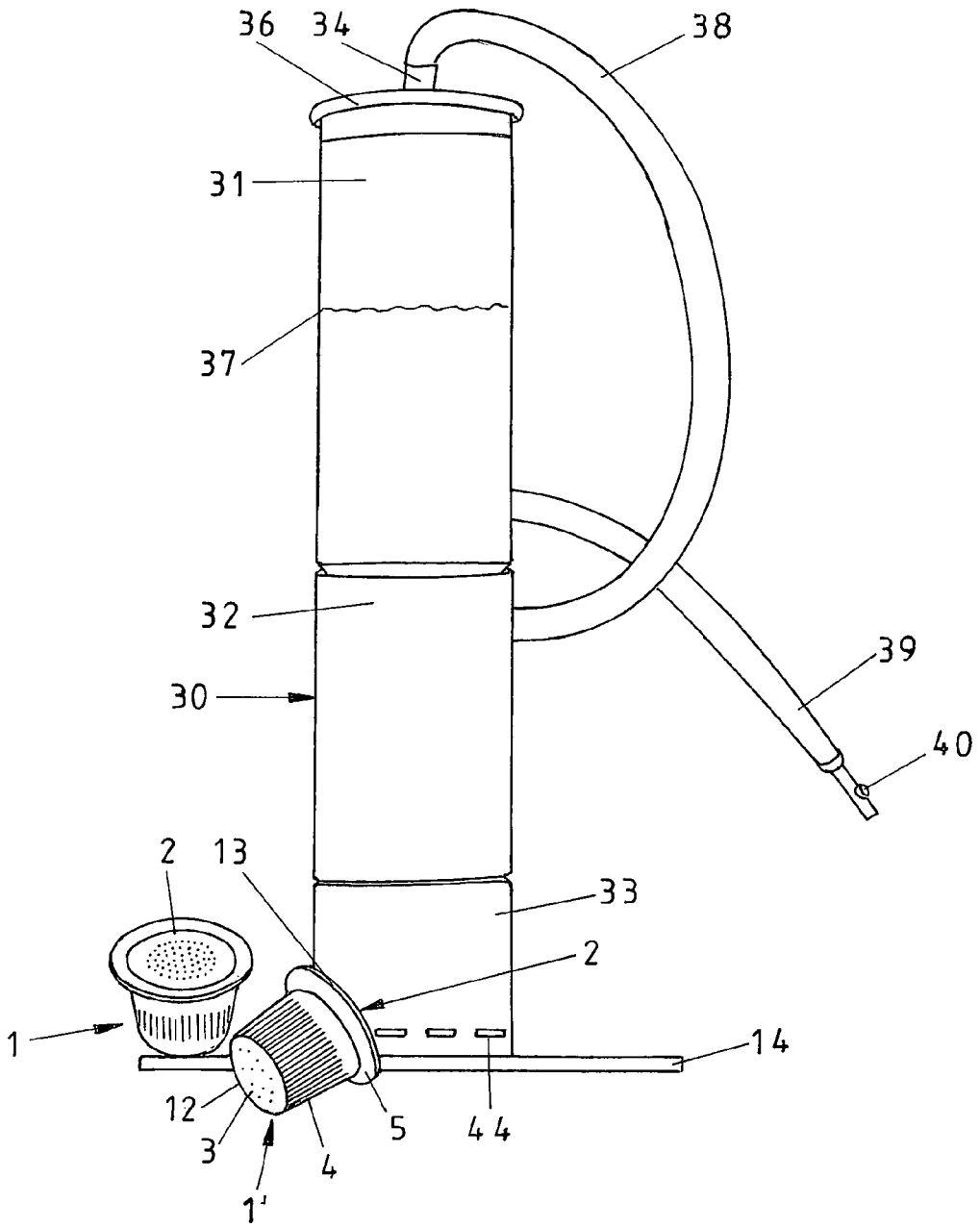
FIG. 1 shows a side view of a waterpipe with two capsules.

The subject-matter of FIG. 1 is a waterpipe 30 which can be fitted with a capsule 1, 1'. The waterpipe 30, also known as a shisha, has an elongate housing. The upper part is formed by the water container 31, the water level in this container being designated 37. This water container 31 can be opened via a container lid 36, for example when the water in it needs to be replaced. A hose 38 or a plurality of hoses 38, 39 can be connected via the port 34, in order to then be operated by the smoker via the mouthpiece 40.

The electronic part 32 is arranged between the water container 31 and the lower heating chamber 33. In the heating chamber 33, the capsules 1, 1' are heated by a heating coil (not shown) sufficiently that the tobacco or smoking medium, with and without additives, contained in the capsule 1, 1' is extracted. The base of the heating chamber 33 is formed by a baseplate 14, which may also be associated with the entire housing. The slits in the heating chamber 33 through which the air is sucked into the heating chamber 33 are designated 44. In the capsule 1', the air-smoking medium outlet 3 is shown, which has a number of through-holes and is formed as an air-smoking medium outlet plate 12. On the other side of the capsule 1', the air inlet 2 is not visible, but what is visible is the upper edge 13, which here has a certain width to facilitate the connection of the air inlet plate 5 of the air inlet 2 to the side wall 4.

Figure 2:
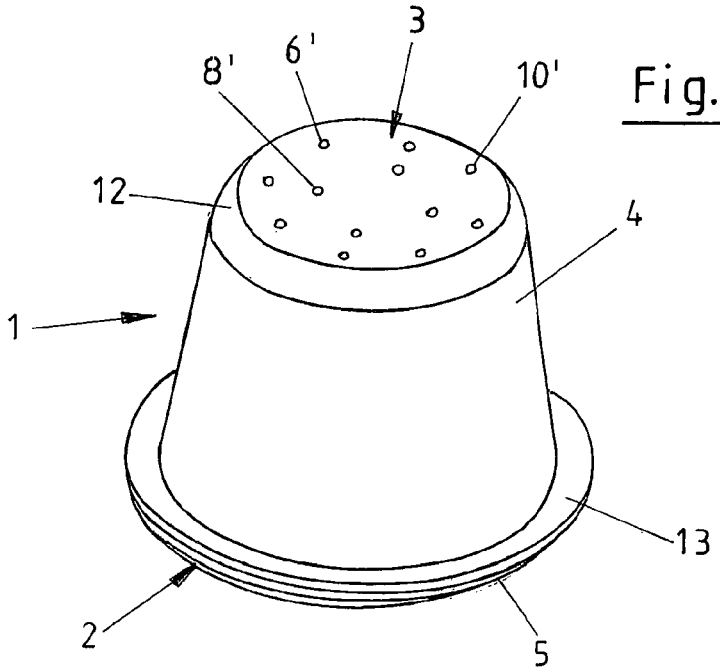
FIG. 2 shows a capsule with the air-smoking medium outlet side.

FIG. 2 shows a corresponding capsule 1 on an enlarged scale, the air-smoking medium outlet 3 or the air and smoking medium outlet plate 12 being visible here. This plate has a plurality of through-holes 6', 8', 10'. The upper edge 13, which the side wall 4 has in the area of the air inlet 2, can also be seen here.

Figure 3:
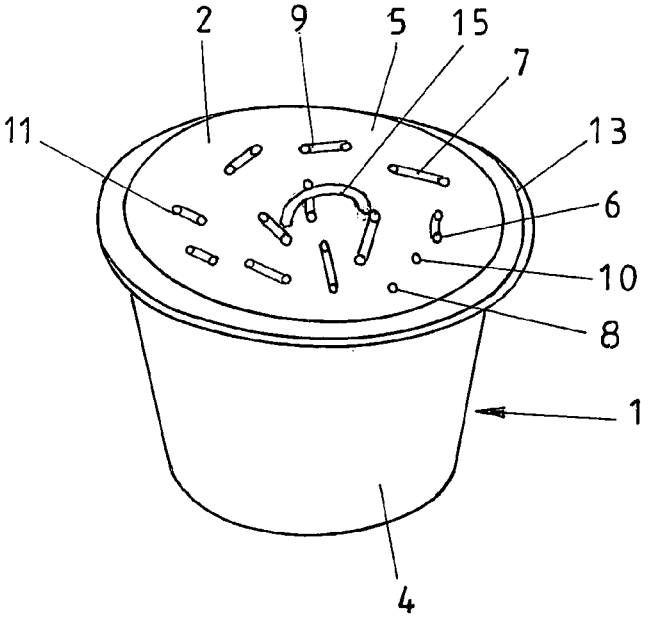
FIG. 3 shows the capsule seen from the air inlet side.

FIG. 3, on the other hand, shows the air inlet 2 or the air inlet plate 5, through-holes 6, 8, 10 as well as through-slots 7, 9, 11 being shown here. In order to be able to handle this air inlet plate 5 more easily, a grip 15 is associated with it, which is formed so as to be foldable. This grip 15 is advantageous if the air inlet plate 5 is threaded or otherwise connected to the side wall 4.

Figure 4:
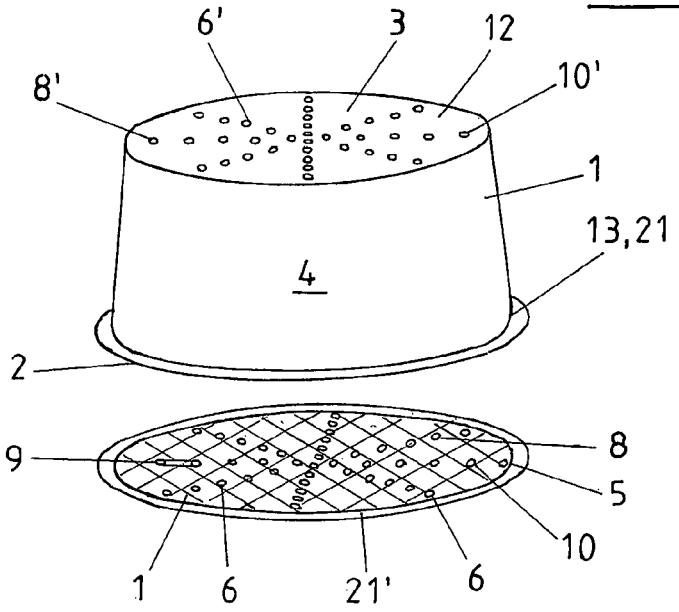
FIG. 4 shows a capsule with an air inlet plate before connection with the side wall.

In the illustration in FIG. 4, the air inlet plate 5 is not yet attached to the air inlet 2, but is still a separate item. However, it can already be seen that the upper edge 13 of the side wall 4 has a widened edge surface 21, in order to facilitate the connection between the air inlet plate 5 and the side wall 4. This is described in greater detail below.

It can also be seen in FIG. 4 that the air-smoking medium outlet plate 12 is provided with through-holes 6', 8', 10' in order to be able to easily and quickly suck out the smoke released inside the capsule 1. This air and smoking medium outlet plate 12 is tightly connected to the edge of the side wall 4, whereas, as can be seen in FIG. 4, the air inlet plate 5 is still to be connected to the side wall 4.

Figure 5:
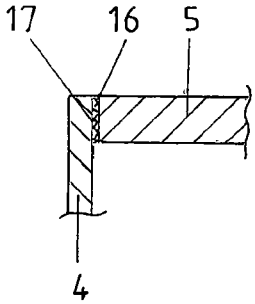
FIG. 5 shows a thread between air inlet plate and side wall.

There are several possibilities for the connection between the air inlet plate 5 and the side wall 4, which are shown in the following Figures. In FIG. 5, the air inlet plate 5 is provided with an external thread 16, which corresponds to the internal thread 17 of the side wall 4, so that the air inlet plate 5 can be screwed in easily and quickly, preferably with the aid of the grip 15. Needless to say, the widened edge surface 21 is then not required.

Figure 6:
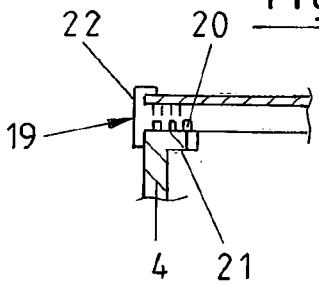
FIG. 6 shows a connection with a hook-and-loop fastener between air inlet plate and side wall.

FIG. 6 shows an embodiment, namely that in which the widened upper edge 13, i.e. the widened edge surface 21, provides the possibility of attaching, for example, a hook-and-loop fastener 19, the catch part 20 of which is associated with, for example, the widened edge surface 21. A click connector is designated 22, which either additionally or alone ensures that the air inlet plate 5 is sufficiently tightly connected to the side wall 4.

Figure 7:
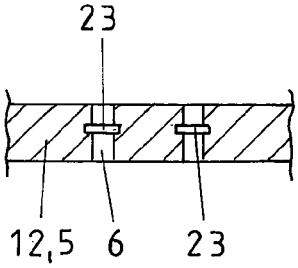
FIG. 7 shows a partial view of an air inlet plate, in section.
Figure 8:
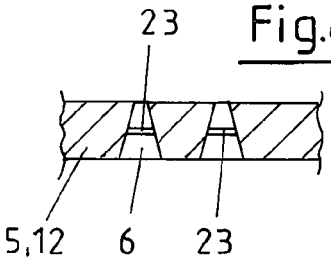
FIG. 8 shows a cross-section through the air inlet plate, with through-holes of a particular shape.

FIGS. 7 and 8 show embodiments of the air inlet plate 5 and also of the air and smoking medium outlet plate 12, with associated through-holes 6, 8 and 6' respectively, which are closed by a foil 23. At the beginning of the smoking programme or when the smoker starts to suck, a corresponding pressure is created through which this foil 23 is slit open in such a way that the necessary air can enter the heating chamber 33 through the slits 44. In FIG. 8, these through-holes 6, 6' are funnel-shaped so that an acceleration can be generated in these through-holes 6, 6'. These particular constructions may be found not only in the through-holes 6, 8, 10 in the air inlet plate 5, but also those in the air-smoking medium outlet plate 12.

Figure 9:
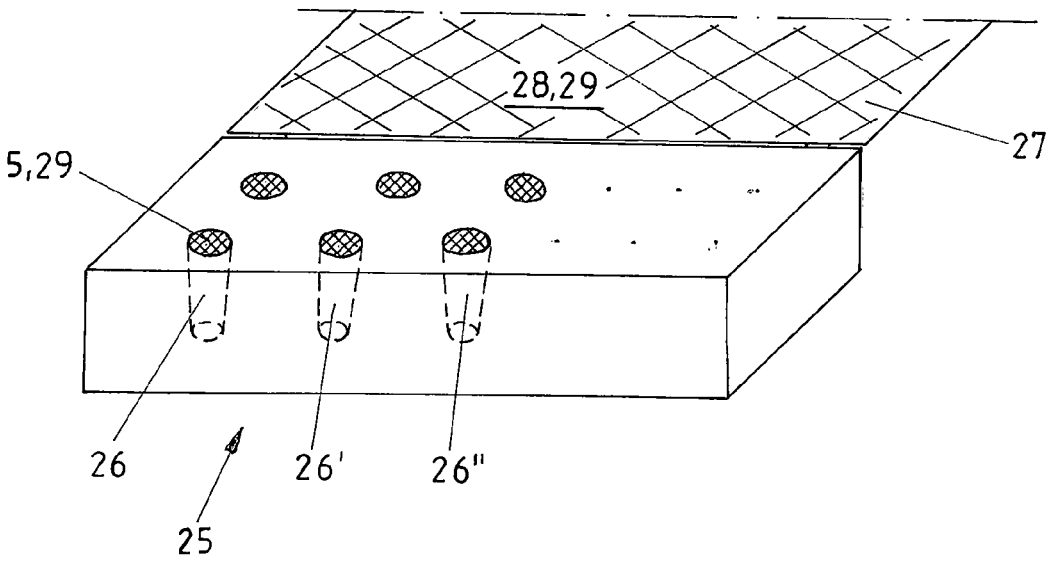
FIG. 9 shows a sales carton, in perspective view.

The capsules 1, 1' shown in FIGS. 2-4 have to be transported safely and are also to be sold, i.e. packaged attractively. This is achieved by using a sales carton 25 as shown in FIG. 9, which has a large number of storage recesses 26 which are adapted to the shape of the capsules 1, so that these capsules 1, 1' can be stored securely therein. For example, a sales carton 25 provided with twelve storage recesses 26 can be easily closed by the lid 27, the lid 27 itself being provided with an advertising surface 28. In addition, this lid 27 has a particular colouration 29 which matches the colouration of the air inlet plate 5 and preferably also the colouration of the storage recesses 26, 26', 26". The smoker can thus immediately recognise, when buying a corresponding sales carton 25, whether and what kind of composition of smoking medium has in this case been chosen for the capsules. He can then easily conclude how he can change or refine this basic composition of smoking medium by additives in such a way that it exactly meets his taste. This is easily possible because, in the capsules 1, 1' shown here, the air inlet plate 5 is releasably connected to the upper rim 13 or the side wall 4.

Figure 10:
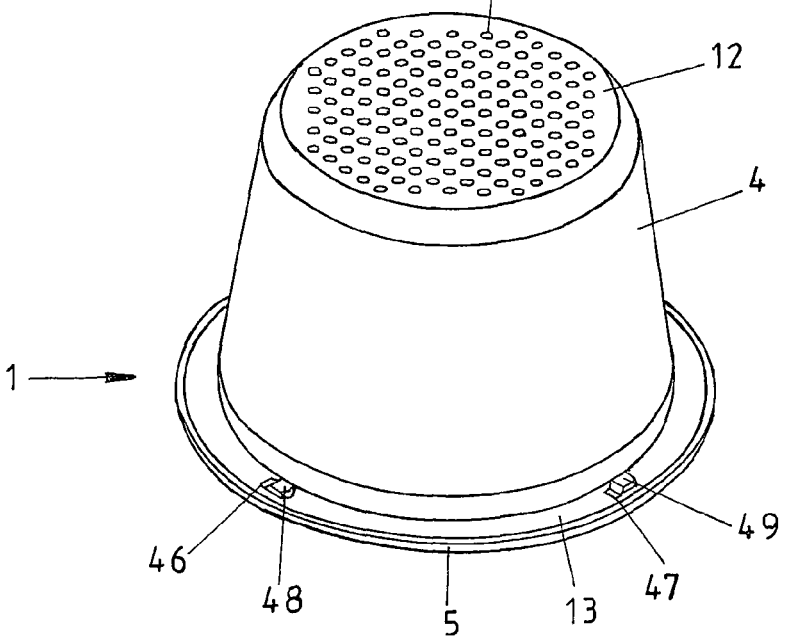
FIG. 10 shows an alternative fixation of plate and side wall and FIG. 11 shows a plate according to FIG. 10.
Figure 11:
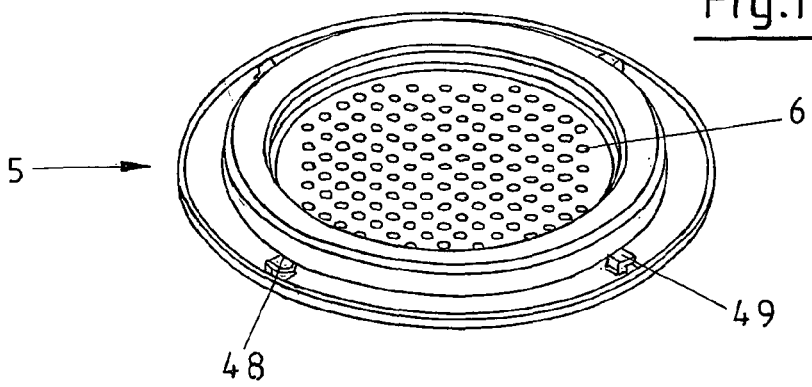

FIG. 10 and FIG. 11 show a solution in which recesses 46, 47 set into the upper edge 13 are associated with the air inlet plate 5, into which tongues 48, 49 that can be inserted therein quickly and easily effect a connection between the air inlet plate 5 and the side wall 4 or upper edge 13. If the capsule 1 is to be reusable, the tongues 48, 49 are made of flexible material; if the capsules 1 are to be used only once, the tongues 48, 49 are formed so as to be easily broken off.

The invention claimed is:

1. A capsule for storing tobacco without or with other heatable additives for an electronic waterpipe comprising a heat-resistant material for storing a smoking medium intended for extraction;

an air inlet and an air-smoking medium outlet and a side wall spaced apart from each other, wherein both the air inlet and the air-smoking medium outlet have a plurality of through-holes and/or slots, wherein the air inlet and/or air-smoking medium outlet with the through-holes comprise an air inlet plate and/or an air-smoking medium outlet plate releasably connected to the side wall and are configured to be reusable, wherein the air inlet plate comprises a protrusion which extends within the side wall and engages an inner edge of the side wall, and wherein the side wall is formed to also maintain the spacing of the air inlet plate and the air-smoking medium outlet plate.

2. The capsule according to claim 1, wherein the air inlet plate has an external thread corresponding with an internal thread on the upper edge of the side wall.

3. The capsule according to claim 2, wherein the air inlet plate is interlocked with the upper edge of the side wall or is interlocked in addition to the external thread.

4. The capsule according to claim 2, wherein the air inlet plate has a click-connection to the upper edge of the side wall or has a click-connection in addition to the external thread.

5. The capsule according to claim 1, wherein the air inlet plate is releasably connected to the upper edge of the side wall by a hook-and-loop fastener.

6. The capsule according to claim 5, wherein the catch part of the hook-and-loop fastener is associated with the upper edge of the side wall, which is formed so as to have a widened edge surface.

7. The capsule according to claim 1, wherein the air inlet plate has through-holes which are closed in a predetermined arrangement in the passive state and which, when a suction force is applied by the smoker, are formed so as to be passable for the smoking medium due to the pressure.

8. The capsule according to claim 7, wherein the through-holes are closed in the passive state by a foil which bursts at a predetermined pressure.

9. The capsule according to claim 7, wherein the air inlet plate and the air-smoking medium outlet plate are equipped with through-holes or through-slots which, when the smoker sucks in, are formed so as to open due to the resulting pressure.

10. The capsule according to claim 1, wherein the through-holes are funnel-shaped, preferably in the air inlet plate, towards the smoking medium.

11. The capsule according to claim 1, wherein the air inlet plate is equipped with an externally seated grip which is formed so as to be foldable.

12. The capsule according to claim 1, wherein the capsule is to be assigned to sales cartons, which have storage recesses adapted to the capsule shape and have a lid with advertising space.

13. The capsule according to claim 12, wherein the sales cartons have six or twelve storage recesses.

14. The capsule according to claim 12, wherein the air inlet plate, the lid and/or the storage recesses have an identical or nearly identical colouration.

15. The capsule according to claim 1, wherein the sidewall comprises a widened upper edge surface and the air inlet plate comprises a corresponding widened edge surface.

16. The capsule according to claim 15, wherein a connection means is provided on the widened upper edge surface and the widened edge surface.

17. The capsule according to claim 16, wherein the connection means comprises a plurality of recesses and tongues.

18. The capsule according to claim 15, wherein the protrusion is provided between the through-holes and the widened edge surface.

19. A capsule for storing tobacco without or with other heatable additives for an electronic waterpipe comprising a heat-resistant material for storing a smoking medium intended for extraction;

an air inlet and an air-smoking medium outlet and a sidewall spaced apart from each other, wherein both the air inlet and the air-smoking medium outlet have a plurality of through-holes and/or slots, wherein the air inlet and/or air-smoking medium outlet with the through-holes further comprise an air inlet plate and/or an air-smoking medium outlet plate releasably connected to the sidewall and are configured to be reusable, wherein the sidewall comprises an upper rim and the air inlet plate is releasable connected to the upper rim;

and wherein the sidewall is formed to also maintain the spacing of the air inlet plate and the air-smoking medium outlet plate.

* * * * *